US005604067A

United States Patent [19]

Nagai et al.

[11] Patent Number: 5,604,067

[45] Date of Patent: Feb. 18, 1997

[54] TONER FOR ELECTROSTATIC LATENT IMAGE DEVELOPING AND MANUFACTURING METHOD OF SAME

[75] Inventors: Yasuki Nagai, Amagasaki; Hideaki Ueda, Kishiwada; Ichiro Demizu, Toyonaka; Mitsutoshi Nakamura, Ibaraki; Yukio Tanigami, Amagasaki, all of Japan

[73] Assignee: Minolta Co., Ltd., Osaka, Japan

[21] Appl. No.: 451,861

[22] Filed: May 26, 1995

[30] Foreign Application Priority Data

May 27, 1994 [JP] Japan ..... 6-115325
Aug. 9, 1994 [JP] Japan ..... 6-186947

[51] Int. Cl.[6] ..... G03G 9/087

[52] U.S. Cl. ..... 430/106.6; 430/137

[58] Field of Search ..... 430/106.6, 111, 430/109, 110, 137

[56] References Cited

U.S. PATENT DOCUMENTS 5,080,992 1/1992 Mori et al. ..... 430/109
5,290,654 3/1994 Sacripante et al. ..... 430/137
5,418,103 5/1995 Muto et al. ..... 430/109
5,422,214 6/1995 Akiyama et al. ..... 430/106.6

FOREIGN PATENT DOCUMENTS 38-2095 3/1963 Japan .

*Primary Examiner*—John Goodrow
*Attorney, Agent, or Firm*—Burns, Doane, Swecker & Mathis, LLP

[57] ABSTRACT

A resin-formed toner for developing electrostatic latent images manufactured by a wet process, wherein 10 parts by weight of said toner is added to 100 parts by weight of deionized water to produce a solution having electrical conductance of 1~100 μS/sec. And a resin-formed toner for developing electrostatic latent images which is manufactured by wet process using a water-insoluble inorganic salt comprising calcium as a dispersion stabilizing agent, wherein the amount of calcium present in the toner is 0.2~10 ppm.

46 Claims, No Drawings

TONER FOR ELECTROSTATIC LATENT IMAGE DEVELOPING AND MANUFACTURING METHOD OF SAME

BACKGROUND OF THE INVENTION

1. Field of the Invention

The present invention relates to a toner for electrostatic latent image developing and manufacturing method of same for developing electrostatic latent images in electrophotography, electrostatic recording, and electrostatic printing.

2. Description of the Related Art

Conventional toners for electrostatic latent image developing for use in developing electrostatic latent images in electrophotography, electrostatic recording, and electrostatic printing are manufactured by a so-called dry pulverization method wherein a pigment such as carbon black and the like is thoroughly mixed by kneading in a thermoplastic resin so as achieve a uniform dispersion, which is subsequently pulverized to a powder of required particle size, i.e., toner, by a suitable fine pulverization device.

In recent years, granulation by wet process as represented by dispersion polymerization, emulsion dispersion and the like which allow production of fine resin particles of smaller and relatively even size have been of interest in place of pulverization methods in view of manufacturing cost reduction and improved image quality. Hereinafter, the method for producing particles by wet process, namely, the method for producing particles in solution as described above shall be referred to as "wet granulation method."

The dispersion polymerization method produces particles by dispersing and polymerizing polymer constituents such as polymeric monomers, polymerization initiators, coloring agents and the like in a dispersion fluid.

The emulsion dispersion method forms droplets of resin solution by dissolving or dispersing binder resin and coloring agent in a suitable organic solvent to produce a colored resin solution which is added to an aqueous dispersion fluid and aggressively mixed. The droplets are heated to remove the organic solvent.

The wet granulation method can correspond well to higher quality images because toner particles of small size can be readily formed. Furthermore, yield is excellent by this method.

Toner produced by the wet granulation method exhibits excellent charging characteristics under normal temperature and humidity, but was found to have inadequate characteristics when charging characteristics were measured after long-term storage under high temperature and high humidity conditions. Therefore, when the toner is subjected to conditions of high temperature and high humidity during shipment and transport, adequate charging characteristics are not exhibited and image quality deteriorates.

Normally, in the aforesaid wet granulation method, a dispersion stabilizer is added to the dispersion fluid to stabilize the dispersion state of the droplets by preventing flocculation of said droplets dispersed in the dispersion fluid.

Although various dispersion stabilizing agents are known, it is particularly desirable to use a calcium-containing inorganic salt with lower water-solubility such as calcium phosphate and the like because of its excellent dispersion stabilization characteristics and the ease with which the dispersion stabilizer can be removed.

Toners produced by the wet granulation method using the aforesaid inorganic salt comprising calcium as a dispersion stabilizer are disadvantageous in that they do not maintain adequate charge amount, such that a large amount of the toner is inadequately charged, charging characteristics deteriorate after storage at high temperature and high humidity, and the charge is reduced during printing.

SUMMARY OF THE INVENTION

An object of the present invention is to provide a toner for developing electrostatic latent images which has an adequate amount of charge.

Another object of the present invention is to provide a toner for developing electrostatic latent images which has a minute amount of inadequately charged toner.

A further object of the present invention is to provide a toner for developing electrostatic latent images which exhibits superior charging characteristics even after long-term storage under, conditions of high temperature and high humidity.

A still further object of the present invention is to provide a toner which does not lose charge during printing.

An even further object of the present invention is to provide a toner for developing electrostatic latent images which is capable of producing high quality images.

To achieve the aforesaid objects, the present invention provides a toner for developing electrostatic latent images manufactured by a wet process, wherein 10 parts by weight of said toner is added to 100 parts by weight of deionized water to produce a solution having electrical conductance of 1~100 μS/sec.

To achieve the aforesaid object, the present invention further provides a toner for developing electrostatic latent images which is manufactured by wet process using a calcium-containing inorganic salt with lower water-solubility as a dispersion stabilizing agent, wherein the amount of calcium present in the toner is 0.2~10 ppm.

To achieve the aforesaid objects the present invention provides washing with water of the resin particles manufactured by a wet process and washing with deionized water in a final stage.

To achieve the aforesaid objects, the present invention further provides washing with water the resin particles manufactured by a wet process using a calcium containig salt with lower water-solubility as a dispersion stabilizer and which have come in contact with an acid solution, and washing with deionized water in a final stage.

These and other objects, features, and advantages of the invention will be better understood taken in conjunction with the following detailed description and claims.

DETAILED DESCRIPTION OF THE INVENTION

The inventors performed various investigations and discovered that changes in charging characteristics of toners under conditions of high temperature and high humidity are dependent on residual ions unavoidably remaining on the surface of the toner after the manufacturing process.

Since processing to disperse binder resin or raw material fluid of resin in a solvent is included in wet granulation methods, generally, dispersion stabilizers, surface active agents and the like which are used for dispersion are removed by washing after granulation. However, simply washing alone does not completely remove ions included in dispersion stabilizers and surface active agents and the like, such that minute amounts of said materials unavoidably remain on the surface of the toner. Furthermore, ions contained in the industrial water used for such washing, particularly halogen ions and sodium ions, remain on the surface of the toner. The present inventors have discovered that minute amounts of these residual ions are the cause of changes in toner charging characteristics after long-term storage under conditions of high temperature and humidity.

The reason for the aforesaid situation is unclear, but it is believed that conditions of high temperature and humidity induce chemical changes in residual ions which do not change chemically under normal temperature and humidity conditions, and this chemical change is the cause of changes in surface characteristics of the toner.

The present inventors discovered, based on the repeated results of investigations regarding the aforesaid findings, that it is possible to maintain superior charging characteristics even after long-term storage under conditions of high temperature and humidity by repeatedly washing the fine particles obtained by wet granulation methods in water or warm water, then washing with deionized water in the final stage prior to drying so as to reduce the amount of impure ion constituent remaining on the surface of said fine particles to an extremely minute range. The amount of ion constituent was investigated by adding and mixing toner with deionized water and determining whether or not the obtained solution had electrical conductance within a predetermined range.

The present inventors further discovered via results of various experiments that calcium remaining on the toner was a cause of the previously described problems.

In wet granulation methods using water-insoluble inorganic salts as dispersion stabilizers, coagulation of droplets is prevented by covering the droplet surface with the inorganic salt used as a dispersion stabilizer within the dispersion fluid. Insoluble inorganic salt therefore adheres to the surface of the manufactured resin particles. Typically, the insoluble inorganic salt adhered to the surface of the particles after granulation is removed by washing so as to dissolve said salts with hydrochloric acid or the like.

When an calcium containig inorganic salt with lower water-solubility is used as a dispersion stabilizer, calcium included in the dispersion stabilizer is believed to adhere in some form to the surface of the resin particles, and it has been determined that such calcium included in the dispersion stabilizer adhering to the surface of the resin particles cannot be adequately removed by simply dissolving with an acid wash. The constituent containing calcium believed to adhere to the surface of the toner has been discovered to be a cause of the previously described problems.

Although the reasons the constituent containing calcium adhering to the surface of the toner is a cause of the previously described problem are still unclear, it is believed that such calcium itself has a degree of chargeability which participates in influencing toner chargeability.

The present inventors discovered that is possible to eliminate the previously described problems through repeated results of experiments based on the aforesaid findings, for example, by repeatedly washing the fine particles obtained by wet granulation methods in an acid wash using an amount of acid corresponding to the amount of dispersion stabilizer used, then washing with water in an amount corresponding to the amount of dispersion stabilizer used, then washing with deionized water in an amount corresponding to the amount of dispersion stabilizer used in the final stage prior to drying so as to reduce the amount of calcium remaining on the surface of the fine particles to a predetermined range.

The present invention essentially discovers the amount of residual ions and amount of residual calcium are factors which have an extremely great influence on characteristics of toner obtained by a wet granulation process, and demonstrates specific numerical value ranges for same.

In the present invention, granulation occurs in a dispersion fluid. The granulation method for producing toner particles by a wet process may be, for example, an emulsion dispersion method.

In emulsion dispersion methods, binder resin, coloring agent, and other additives as required are dissolved or dispersed in a nonaqueous solvent to produce a colored resin solution which is subjected to emulsion dispersion in an aqueous dispersion fluid to form an oil-in-water (O/W) emulsion. Granulation is accomplished by later removing the nonaqueous solvent from the O/W emulsion. The O/W emulsion is a dispersion fluid wherein the oil constituents are dispersed in an aqueous dispersion fluid forming droplets therein.

Binder resins usable in emulsion dispersion are not specifically limited if they can be dissolved in a nonaqueous solvent, i.e., are insoluble or only very slightly soluble in water. Examples of useful materials include styrene resin, (meth)acrylic resin, styrene(meth)acrylic copolymer resin, olefin resin, polyester resin, polyamide resin, polycarbonate resin, polyether resin, polyvinyl acetate resin, polysulfon resin, epoxy resin, polyurethane resin, urea resin and like commonly known resins which can be used singly or in combinations of two or more kinds.

It is desirable that the aforesaid binder resin has a glass transition temperature (Tg) of 50°~70° C., number-average molecular weight (Mn) of 1,000~50,000, and preferably 3,000~20,000, molecular weight distribution (Mw/Mn) expressing the ratio of Mn to weight-average molecular weight (Mw) of 2~60. When the ultimately obtained toner has a glass transition temperature Tg which is less than 50° C., toner heat resistance is reduced, whereas fixing characteristics are reduced when Tg exceeds 70° C. Furthermore, high temperature offset readily occurs when number-average molecular weight Mn is less than 1,000, whereas low temperature offset readily occurs when Mn exceeds 50,000. When the ratio Mw/Mn is less than 2, the non-offset region becomes narrow, whereas low temperature offset readily occurs when the ratio Mw/Mn exceeds 60. When the toner of the present invention is used with oil application fixing methods, the ratio Mw/Mn is desirably 2~5, and when the toner is used with oilless fixing methods, the ratio Mw/Mn is desirably 20~50.

Examples of useful nonaqueous solvents for dissolving the aforesaid binder resins, insofar as such solvent dissolves the aforesaid binder resin and is insoluble or only slightly soluble in water, include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethyl acetate, methylethyl ketone, methylisobutyl ketone and the like which may be used singly or in combinations of two or more kinds. Particularly desirable are aromatic solvents such as toluene, xylene and the like, and halogenated hydrocarbons such as methylene chloride, 1,2-dichloroethane, chloroform, carbon tetrachloride and the like.

Various types and colors of organic and inorganic pigments may be used as coloring agents included in the toner, such as those listed below.

Examples of useful black pigments include carbon black, copper oxide, manganese dioxide, aniline black, active carbon, nonmagnetic ferrite, magnetic ferrite, magnetite and the like.

Examples of useful yellow pigments include chrome yellow, zinc yellow, cadmium yellow, yellow oxide, mineral fast yellow, nickel titanium yellow, naples yellow, naphthol yellow S, hansa yellow G, hansa yellow 10G, benzidine yellow G, benzidine yellow GR, quinoline yellow lake, permanent yellow NCG, tartrazine lake and the like.

Examples of useful orange color pigments include chrome orange, molybdate orange, permanent orange GTR, pyrazolone orange, vulcan orange, indanthrene brilliant orange RK, benzidine orange G, indanthrene brilliant orange GK and the like.

Examples of useful red pigments include red oxide, cadmium red, red lead, mercury thiocyanate, cadmium, permanent red 4R, lithol red, pyrazolone red, watchung red, calcium salts, lake red C, lake red D, brilliant carmine 6B, eosin lake, rhodamine lake B, alizarin lake, brilliant carmine 3B and the like.

Examples of useful violet pigments include manganese violet, fast violet lake B, methyl violet lake and the like.

Examples of useful blue pigments include prussian blue, cobalt blue, alkali blue lake, victoria blue lake, phthalocyanine blue, metal-free phthalocyanine blue, partially chlorinated phthalocyanine blue, fast sky blue, indanthrene blue BC and the like.

Examples of useful green pigments include chrome green, chrome oxide, pigment green B, micalite green lake, final yellow-green G and the like.

Examples of useful white pigments include zinc oxide, titanium oxide, antimony oxide, zinc sulfide, calcium carbonate, tin oxide and the like.

Examples of useful extender pigments include baryte powder, barium carbonate, clay, silica, white carbon, talc, alumina white and the like.

The aforesaid coloring agents may be used singly or in combinations of two or more. Coloring agents are used at a rate of 1~20 parts by weight, and preferably 2~15 parts by weight, relative to 100 parts by weight of binder resin contained in the toner. When the coloring agent exceeds 20 parts by weight, toner fixing characteristics are reduced. When the coloring agent is less than 1 parts by weight, a desired image density cannot be obtained.

Other constituents in addition to the aforesaid binder resin and coloring agent may be added to the toner of the present invention as necessary, such as, for example, charge controlling agents, magnetic powder, offset inhibitors and the like.

Various types of materials which participate in positive or negative charging via triboelectric charging may be used as charge controlling agents. Examples of useful positive charge controlling agents include nigrosine dyes such as nigrosine base EX (Oriental Chemical Co., Ltd.) and the like, quaternary ammonium salts such as P-51 (Oriental Chemical Co., Ltd.), Copy Charge PX VP435 (Hoechst Co.) and the like, and imidazole compounds such as alkoxidated amine, alkoxidated amide, molybdate chelate pigment, and PLZ1001 (Shikoku Kasei Kogyo K.K.) and the like.

Examples of useful negative charge controlling agents include metal complexes such as Bontron S-22 (Oriental Chemical Co.), Bontron S-34 (Oriental Chemical Co.), Bontron E-81 (Oriental Chemical Co.), Bontron E-84 (Oriental Chemical Co.), Aisen Spilon Black TRH (Hodogaya Kagaku K.K.) and the like, quaternary ammonium salts such as thioindigo pigment, Copy Charge NX VP434 (Hoechst Co.) and the like, calyx allene compounds such as Bontron E-89 (Oriental Chemical Co.) and the like, and fluoride compounds such as magnesium fluoride, fluorocarbon and the like. Examples of useful metal complexes for negative charge controlling agents in addition to the aforesaid complexes include oxycarboxylic acid metal complexes, dicarboxylic acid metal complexes, amino acid metal complexes, diketone metal complexes, diamine metal complexes, benzene containing azo radicals-benzene derivative structural metal complexes, benzene containing azo radicals-napthalene derivative structural metal complexes and the like.

The aforesaid charge controlling agents preferably have a particle size of about 10~100 mμm to achieve uniform dispersion. As to commercially available products which have a particle size greater than the aforesaid upper limit, it is desirable that such particles be adjusted to a suitable size using a well known method such as pulverization via jet mill or the like.

Useful examples of magnetic powders include magnetite, γ-hematite, various types of ferrite and the like.

Examples of useful offset inhibitors include various kinds of wax, particularly low molecular weight polypropylene, polyethylene, or polyolefin waxes such as oxided polypropylene, polyethylene and the like.

Devices such as a ball mill, sand grinder, homomixer, ultrasonic homomixer and the like may be used to dissolve or disperse resin, coloring agent, and other toner constituents in the nonaqueous solvent.

Solid content concentration in the colored resin solution obtained by dissolving or dispersing binder resin, coloring agent, and other additives in a nonaqueous solvent must be set so as to solidify droplets to fine particles when the O/W emulsion comprising a dispersion of colored resin solution in an aqueous dispersion fluid is heated to remove the nonaqueous solvent from the droplets, i.e., said solid content concentration being 5~50 percent-by-weight, and preferably 10~40 percent-by-weight.

In order to form the O/W emulsion, a mixing device such as a homomixer is used with a method of adequately mixing the solution of colored resin fluid and aqueous dispersion. When the mixing time is too short, a sharp particle size distribution cannot be obtained; a mixing time of 10 min or longer is therefore desirable.

The ratio (Vp/Vw) of colored resin solution volume Vp and aqueous dispersion volume Vw is $Vp/Vw \leqq 1$, and preferably $0.3 \leqq Vp/Vw \leqq 0.7$. When $Vp/Vw > 1$, a stable O/W emulsion cannot be formed, phase transition occurs during the processing, and it is likely a W/O emulsion will form.

Examples of useful aqueous dispersion fluids for forming the O/W emulsion may include water or water soluble organic solvents to the degree that the emulsion does not breakdown in water, such as water/methanol mix (weight ratio: 50/50~100/0), water/ethanol mix (weight ratio: 50/50~100/0), water/acetone mix (weight ratio: 50/50~100/0), water/methylethylketone mix (weight ratio: 70/30~100/0) and the like.

Dispersion stabilizers, and dispersion co-stabilizers may be added as necessary to the aqueous dispersion fluid. Dispersion stabilizers have hydrophilic colloids in an aqueous dispersion fluid. Examples of useful materials include gelatin, acacia gum, agar, or cellulose derivatives such as hydroxymethyl cellulose, hydroxyethyl cellulose, hydroxypropyl cellulose and the like, or synthetic polymers such as polyvinyl alcohol, polyvinyl pyrrolidone, polyacrylamide, polyacrylate and the like. In addition, calcium-containig inorganic salts with lower water-solubility such as water-insoluble calcium phosphates may be used.

Examples of useful calcium-containing inorganic salts include water-insoluble calcium phosphates, calcium sulfate, calcium carbonate and the like. Examples of useful water-insoluble calcium phosphates include tricalcium phosphate, calcium diphosphate, calcium phosphate hydroxide, calcium pyrophosphate, calcium polyphosphate, mixed crystals thereof, and complex salts such as calcium fluoride, calcium chloride and the like. These dispersion stabilizers may be used singly or in combinations of two or more.

When calcium phosphates are used as dispersion stabilizers in emulsion dispersion methods, irregularities are formed in the surface of the toner, thereby producing irregularly shaped toner particles. Therefore, adequate cleaning can be obtained in image forming apparatus that use blade-type cleaning methods.

The pH of the aqueous dispersion fluid containing calcium-containing inorganic salts with lower water-solubility is desirably 5~14, and preferably 6~12, in consideration of the stability of the calcium-containing salts. Methods can be used which use additives such as alkali, e.g., calcium hydroxide, sodium hydroxide and the like, and acids such as hydrochloric acid, phosphoric acid and the like in order to regulate the pH of the aqueous dispersion fluid.

The amount of calcium-containing inorganic salt used as the dispersion stabilizer is 0.5~10 percent-by-weight relative to the total weight of the aqueous dispersion fluid used. When the dispersion stabilizer is less than 0.5 percent by weight, an adequately stable state of the dispersed droplets cannot be obtained. When the dispersion stabilizer exceeds 10 percent by weight, the incorporation of the dispersion stabilizer within the resin particles becomes a problem.

During dispersion of the colored resin solution in the aqueous dispersion fluid or after said dispersion is completed, a dispersion stabilizer may be added again. This readdition of a dispersion stabilizer is effective in preventing flocculation of the droplets or precipitated resin particles.

Examples of useful co-stabilizers include natural surface active agents such as saponin, nonionic surface active agents such as alkylene oxide, glycerine, glycidol and the like, and anionic surface active agents containing acid groups such as carbonic acid, sulfonic acid, phosphoric acid, sulfate group, phosphate group and the like. Particularly when calcium phosphate is used as a dispersion stabilizer, an anionic surface active agent such as dodecyl benzene sodium sulfonate, lauryl sulfate and the like is preferable, and when polyvinyl alcohol is used as a dispersion stabilizer, an anionic surface active agent is preferable.

The mixture ratio is desirably 1/1,000~10/100, and preferably 2/1,000~8/100. When the mixture ratio is less than 1/1,000, adequate dispersion stability cannot be obtained, and when the mixture ratio exceeds 10/100, emulsification is excessive and causes flocculation of droplets, or the dispersion stabilizer and dispersion co-stabilizer cannot be sufficiently removed after granulation.

Methods usable to remove the aqueous solvent from the O/W emulsion include methods which gradually heat the entire system and completely vaporize the nonaqueous solvent in the droplets, or methods which spray the O/W emulsion through dry air to completely remove the nonaqueous solvent in the droplets, and form fine toner particles form which the aqueous dispersion fluid are gradually evaporated.

Emulsion dispersion methods characteristically may select among many types of usable resins compared to dispersion polymerization methods.

Other wet granulation process include granulation methods including polymerization process, such as, for example, dispersion polymerization, emulsion polymerization, soap-free emulsion polymerization, microcapsulation (interfacial polymerization, in-situ polymerization and the like), nonaqueous dispersion polymerization and the like.

In dispersion polymerization methods, polymerization constituents comprising additives such as polymerizable monomers, polymerization initiators, coloring agents and charge controlling agents as necessary, magnetic powder, offset inhibitors and the like, which are suspended in a dispersion medium to form oil droplet dispersion particles. Granulation is accomplished by heating and polymerizing the aforesaid materials.

Examples of useful polymerizable monomers for dispersion polymerization include styrene monomers such as styrene, methyl styrene, methoxy styrene, butyl styrene, phenyl styrene, ethyl styrene, chlorostyrene and the like, acrylic acid or methacrylate monomers such as methyl acrylate, ethyl acrylate, propyl acrylate, butyl acrylate, dodecyl acrylate, stearyl acrylate, ethylhexyl acrylate, acrylamide, methyl methacrylate, ethyl methacrylate, propyl methacrylate, butyl methacrylate, octyl methacrylate, dodecyl methacrylate, ethylhexyl methacrylate, stearyl methacrylate and the like, ethylene, propylene, butylene, vinyl chloride, vinyl acetate, acrylonitrile and the like used singly or in combinations of two or more. Furthermore, the aforesaid monomers may be used in the form of prepolymers.

Examples of useful polymerization initiators for dispersion polymerization include peroxide initiators such as benzoyl peroxide, lauroyl peroxide, stearyl peroxide and the like, and azobis initiators such as 2,2'-azobisisobutyronitrile, 2,2'-azobis-(2,4-dimethylvaleronitrile) and the like.

Oil droplet dispersion particles formed by suspended polymerization constituents in a dispersion fluid may be aggressively mixed using a dispersion device of a high-speed mixing type such as a homomixer, homogenizer and the like.

Polymerization may be accomplished by heating a solution containing dispersed polymerizable constituents to the temperature optionally higher than the decomposition temperature of the polymerization initiator, typically 40°~150° C.

Dispersion stabilizers may be added to the dispersion fluid to prevent reflocculation of the dispersed particles. The same materials as previously mentioned in the aforesaid emulsion dispersion method may be used as dispersion stabilizers.

In dispersion polymerization methods, it is necessary to suppress the amoung of residual monomers within the resin particles. When there are a large amounts of residual monomers, flocculation occurs when dispersion stabilizer is removed by washing, odor from the obtained toner, instability of charging characteristics, dispersion of softening temperature and the like result. In order to suppress residual monomers, it is desirable that prepolymers are used in multistage polymerization wherein the first half of the reaction is polymerization at low temperature (40°~80° C.), and the second half of the reaction is polymerization at high temperature (80°~150° C.).

Dispersion stabilizers may also be added during or following completion of polymerization. The readdition of dispersion stabilizers is effective in preventing flocculation of droplets, and flocculation of the granulated resin particles.

In the present invention, resin particles granulated by a wet process are cleaned, and 10 parts by weight toner is added to 100 parts by weight deionized water and mixed to produce a solution of electrical conductance of 1~100 μS/cm, and preferably 1~50 μS/cm.

In cleaning the resin particles, it is desirable to wash with water, and in the final stage wash several times with deionized water. The electrical conductance of the deionized water for washing is desirably 0.5 μS/cm or less.

When calcium-containing inorganic salts with lower water-solubility are used as dispersion stabilizers, the amount of residual calcium on the toner is 0.2~10 ppm, and is accomplished by methods such as washing in an acid wash then manufactured by a wet process, then washing with water, and in a final stage washing with deionized water prior to drying.

A well known analyzing device such as, for example, ICP spectral analyzer, X-ray micronalayzer, fluorescent X-ray analyzer and the like to measure the amount of residual calcium remaining on the toner.

Examples of useful methods for the aforesaid acid wash include methods wherein dispersion stabilizer adhered to the surface of the resin particles is dissolved by adding acid such as hydrochloric acid, nitric acid, sulfuric acid and the like to the solution containing said resin particles after the resin particles are formed. It is desirable that the pH of the solution is set at 1~2 and mixing occurs for 30 min or longer to completely dissolve the dispersion stabilizer. It is desirable that the temperature of the solution containing the resin particles be maintained at 30° C. or less due to concern that the dispersion stabilizer dissolved when the solution containing the resin particles give off heat via the addition of the acid may be incorporated in the resin particles.

After the acid wash, the resin particles are filtered, and the dispersion stabilizer, dispersion co-stabilizer and the like are washed from the surface of the resin particles with water.

The water wash is accomplished by washing the filtered resin particles with tap water or the like, then washing repeatedly with deionized water. The halogen ions contained in the dispersion stabilizer, dispersion co-stabilizer, and tap water used in the water wash are sufficiently reduced by washing repeatedly with deionized water prior to drying. Excellent cleaning efficiency is achieved by using deionized water having electrical conductance of 0.5 μS/cm or less.

When the amount of residual calcium on the toner is less than 0.2, the particle size distribution is broad due to flocculation during washing, thereby causing increase of abnormal shape particles and scattering.

After the washed resin particles are dried, they may be classified as necessary to obtain a toner for developing electrostatic latent images having a mean particles size of 2~15 pm, and preferably 4~10 μm.

DETAILED DESCRIPTION OF THE PREFERRED EMBODIMENTS

The preferred embodiments of the present invention are described hereinafter. In the following description, "parts" refers to "parts by weight."

Embodiment 1

In 400 parts toluene were dissolved 100 parts polyester resin (NE-382; Kao K.K.). To this solution were added 6 parts phthalocyanine pigment and 2 parts zinc metal complex (E-84: Oriental Chemical Co.), and mixed with a ball mill for 3 hr to obtain a colored resin solution by dispersion.

On the other hand, 0.1 parts sodium lauryl sulfate (Wako Pure Chemical Industries, Ltd.) were dissolved in 1,000 parts aqueous solution containing 4 parts calcium phosphate hydroxide as a dispersion stabilizer to obtain a regulated aqueous dispersion fluid.

The previously described colored resin solution was suspended in the aforesaid aqueous dispersion fluid using a model TK autohomomixer (Tokushu Kika Kogyou K.K.). At this time, the rotational speed of the homomixer is adjusted so as to form droplets having a mean particle size of 3~12 μm.

The resin suspension fluid thus obtained was allowed to stand for 5 hr at a temperature of 60°~65° C. and atmospheric pressure of 70~140 mmHg to remove the toluene from the droplets and precipitate out the resin particles. After dissolving calcium phosphate hydroxide via concentrated hydrochloric acid, the resin particles were filtered.

Then, the resin particles were suspended with stirring in a 5-fold volume of tap water for 30 min, and then filtered. This sequence was repeated three times. After the sequence were completed, the resin particles were then suspended with stirring in a 5-fold volume of deionized water (electrical conductance: 0.1 μS/cm) for 30 min, and filtered. This sequence was also repeated twice.

Thereafter, the resin particles were dried suing a slurry drying device (Disparcoat: Nisshin Engineering K.K.) to obtain toner 1 having a mean particle size of 6 μm.

Embodiment 2

Resin particles obtained in the same manner as in embodiment 1 were suspended with stirring in a 5-fold volume of tap water for 30 min, then filtered. This sequence of suspension and filtration was repeated twice. After the sequence were completed, the resin particles were then suspended with stirring in a 5-fold volume of deionized water (electrical conductance: 0.1 μS/cm) for 30 min, and subsequently filtered. This sequence was also repeated twice. The resin particles were then dried in the same manner as in embodiment 1 to obtain toner 2.

Embodiment 3

Resin particles obtained in the same manner as in embodiment 1 were suspended with stirring in a 5-fold volume of tap water for 30 min, then filtered. The resin particles were then suspended with stirring in a 5-fold volume of deionized water (electrical conductance: 0.1 μS/cm) for 30 min, and subsequently filtered. The sequence of suspension with deionized water and filtration was repeated twice. The resin particles were then dried in the same manner as in embodiment 1 to obtain toner 3.

Embodiment 4

Resin particles obtained in the same manner as in embodiment 1 were suspended with stirring in a 5-fold volume of tap water for 30 min, then filtered. This sequence of suspension and filtration was repeated twice. The resin particles were then suspended with stirring in a 5-fold volume of deionized water (electrical conductance: 0.1 μS/cm) for 30 min, and filtered. The resin particles were then dried in the same manner as in embodiment 1 to obtain toner 4.

Embodiment 5

Resin particles obtained in the same manner as in embodiment 1 were suspended with stirring in a 5-fold volume of tap water for 30 min, then filtered. This sequence was repeated three times. After the sequence of suspension and filtration were completed, the resin particles were then suspended with stirring in a 5-fold volume of deionized water (electrical conductance: 0.1 μS/cm) for 30 min, and filtered. This sequence was also repeated three times. The resin particles were then dried in the same manner as in embodiment 1 to obtain toner 5.

Embodiment 6

Resin particles obtained in the same manner as in embodiment 1 were suspended with stirring in a 10-fold volume of tap water for 30 min, then filtered. This sequence was repeated ten times. After the sequence of suspension and filtration were completed, the resin particles were then suspended in a 10-fold volume of deionized water (electrical conductance: 0.1 μS/cm) for 30 min, and filtered. This sequence was also repeated ten times. The resin particles were then dried in the same manner as in embodiment 1 to obtain toner 6.

Embodiment 7

A resin suspension was obtained in the same manner as described in embodiment 1 with the exception that dimethyl quinacridone pigment instead of phthalocyanine pigment, and the aqueous dispersion fluid comprised 0.1 parts sodium lauryl sulfate (Wako Pure Chemical Industry, Ltd.) dissolved in 1,000 parts aqueous solution containing 1.5% hydrocalcium phosphate as a dispersion stabilizer.

After adding 500 parts of 5 parts hydrocalcium phosphate aqueous solution, the suspension was allowed to stand for 5 hr at a temperature of 60°~65° C. and atmospheric pressure of 70~140 mmHg to remove the toluene. After the hydrocalcium phosphate was dissolved by concentrated hydrochloric acid, the suspension was filtered to obtain resin particles.

The thus obtained resin particles were suspended with stirring for 30 min in a 10-fold volume of tap water, then filtered. This sequence was repeated three times. After the sequence were completed, the resin particles were suspended with stirring for 30 min in a 5-fold volume of deionized water (electrical conductance: 0.5 μS/cm), and filtered. This sequence was also repeated three times. The resin particles were dried in the same manner as described in embodiment 1 to obtain toner 7.

Embodiment 8

| | |
|---|---|
| *Styrene | 100 parts |
| *n-butyl methacrylate | 35 parts |
| *Methacrylic acid | 5 parts |
| *2,2-azobisisobutyronitrile | 0.5 parts |
| *Carbon black (Mitsubishi Kasei) | 8 parts |
| *Charge controlling agent (Hodogaya Kagaku; Aizen Spolon Black TRH) | 3 parts |
| *Low-molecular weight *polypropylene (Sanyo Kasei) | 3 parts |

The above materials were mixed using a sand stirrer to produce polymerization constituents. These polymerization constituents were injected into an aqueous dispersion fluid comprising 500 parts water, 20 parts calcium phosphate hydroxide, and 0.1 parts sodium dodecyl sulfate (Wako Pure Chemical Industry, Ltd.) using a TK homomixer (Tokushu Kika Kogyo) operating at a rate of 8,000 rpm to accomplish polymerization for 5 hr at 60° C., then accomplishing polymerization for 1 hr at a temperature to 75° C., and the resin particles were precipitated out. After cooling, the calcium phosphate hydroxide was dissolved by concentrated hydrochloric acid, and the obtained resin particles were filtered.

The obtained resin particles were suspended in a 10-fold volume of tap water for 30 min, then filtered. The resin particles were then suspended with stirring in a 5-fold volume of tap water for 30 min, and filtered. This sequence was repeated twice. After the sequence were completed, the resin particles were suspended with stirring in a 5-fold volume of deionized water (electrical conductance: 0.2 μS/cm) for 30 min, and filtered. This sequence was also repeated twice. The resin particles were subsequently dried in the same manner as described in embodiment 1 to obtain toner 8 having a mean particle size of 6 μm.

Embodiment 9

The colored resin particles were regulated in the same sequence as described in embodiment 1, and the aqueous dispersion fluid was regulated by dissolving 0.1 parts sodium lauryl sulfate (Wako Pure Chemical Industry, Ltd.) in 1,000 parts aqueous solution containing 3 parts polyvinyl alcohol as a dispersion stabilizer.

The aforesaid colored resin particles were suspended in the aqueous dispersion fluid using a TK homomixer (Tokushu Kika Kogyo). The rotational speed of the homomixer was adjusted to produce droplets having a mean particle size of 3~12 μm.

The obtained resin suspension was allowed to stand for 5 hr at a temperature of 60°~65° C. and atmospheric pressure of 70~140 mmHg to remove the toluene from the droplets. After the resin particles were precipitated out, they were filtered.

Then, the resin particles were suspended with stirring for 30 min in a 5-fold volume of warm tap water heated to 40° C., then the filtered. This sequence was repeated five times. After the sequence were completed, the resin particles were suspended with stirring in a 5-fold volume of deionized water (electrical conductance: 0.1 μS/cm) for 30 min, and filtered. This sequence was also repeated twice. The resin particles were then dried in the same manner as described in embodiment 1 to obtain toner 9.

Embodiment 10

The resin suspension was regulated in the same sequence as described in embodiment 1, then the toluene was removed from the droplets within the resin suspension, and the resin particles were precipitated. The solution containing the resin particles was maintained at a fluid temperature of less than 30° C., and 1N of hydrochloric acid was gradually added to achieve a solution pH of 1.6 to dissolve the calcium phosphate hydroxide. After mixing for 30 min, the resin particles were filtered.

Then, the resin particles were suspended with stirring for 30 min in a 5-fold volume of tap water, then filtered. This sequence was repeated three times. After the sequence were completed, the resin particles were then suspended with stirring in a 5-fold volume of deionized water (electrical conductance: 0.1 μS/cm) for 30 min, and filtered. This sequence was also repeated three times.

Thereafter, the resin particles were dried using a slurry drier (Disparcoat; Nisshin Engineering) to obtainer toner 10 having a mean particle size of 6 pm.

Embodiment 11

The resin suspension was regulated in the same sequence as described in embodiment 1, then the toluene was removed from the droplets within the resin suspension, and the resin particles were precipitated. The solution containing the resin particles was maintained at a fluid temperature of less than 30° C., and 1N of hydrochloric acid was gradually added to achieve a solution pH of 1.2 to dissolve the calcium phosphate hydroxide. After continuous mixing for 1 h, the resin particles were filtered.

Then, the resin particles were suspended with stirring for 30 min in a 5-fold volume of tap water, then filtered. This sequence was repeated three times. After the sequence were completed, the resin particles were then suspended with stirring in a 5-fold volume of deionized water (electrical conductance: 0.1 μS/cm) for 30 min, and filtered. This sequence was also repeated five times.

Thereafter, the resin particles were dried using a slurry drier (Disparcoat; Nisshin Engineering) to obtainer toner 11 having a mean particle size of 11 μm.

Embodiment 12

The resin suspension was regulated in the same sequence as described in embodiment 1, then the toluene was removed from the droplets within the resin suspension, and the resin particles were precipitated. The solution containing the resin particles was maintained at a fluid temperature of less than 30° C., and 4N of hydrochloric acid was gradually added to achieve a solution pH of 1.5 to dissolve the calcium phosphate hydroxide. After continuous mixing for 1 h, the resin particles were filtered.

Then, the resin particles were suspended with stirring for 30 min in a 5-fold volume of tap water, then filtered. This sequence was repeated twice. After the sequence were completed, the resin particles were then suspended with stirring in a 5-fold volume of deionized water (electrical conductance: 0.1 μS/cm) for 30 min, and filtered. This sequence was also repeated twice.

Thereafter, the resin particles were dried using a slurry drier (Disparcoat; Nisshin Engineering) to obtainer toner 12 having a mean particle size of 6 μm.

Embodiment 13

The resin suspension was regulated in the same sequence as described in embodiment 1, then the toluene was removed from the droplets within the resin suspension, and the resin particles were precipitated. The solution containing the resin particles was maintained at a fluid temperature of less than 30° C., and 2N of hydrochloric acid was gradually added to achieve a solution pH of 1.8 to dissolve the calcium phosphate hydroxide. After continuous mixing for 40 min, the resin particles were filtered.

Then, the resin particles were suspended with stirring for 30 min in a 5-fold volume of tap water, then filtered. The resin particles were then suspended with stirring in a 5-fold volume of deionized water (electrical conductance: 0.1 μS/cm) for 30 min, and filtered. The sequence of suspension with deionized water and filtration was repeated twice.

Thereafter, the resin particles were dried using a slurry drier (Disparcoat; Nisshin Engineering) to obtainer toner 13 having a mean particle size of 6 μm.

Embodiment 14

In 400 parts dichloromethane were dissolved 100 parts styrene-butyl methacrylate resin (softening point: 121° C.; Tg=65° C.; Mn=2300; Mw/Mn=8.5). To this solution were added 6 parts dimethyl quinacridone pigment and 2 parts zinc metal complex (E-84: Oriental Chemical Co.), and mixed with a ball mill for 3 hr to obtain a colored resin solution by dispersion.

On the other hand, 0.1 parts sodium lauryl sulfate (Wako Pure Chemical Industries, Ltd.) were dissolved in 1,000 parts aqueous solution containing 1.5 parts calcium phosphate hydroxide as a dispersion stabilizer to obtain a regulated aqueous dispersion fluid.

The previously described colored resin solution was suspended in the aforesaid aqueous dispersion fluid using a model TK autohomomixer (Tokushu Kika Kogyou K.K.). At this time, the rotational speed of the homomixer is adjusted so as to form droplets having a mean particle size of 3~12 μm.

After adding 500 parts aqueous solution containing 5 percent-by-weight calcium phosphate hydroxide, the resin suspension fluid thus obtained was allowed to stand for 5 hr at a temperature of 35°~40° C. and normal pressure to remove the dichloromethane from the droplets and precipitate out the resin particles.

The solution containing the resin particles was maintained at a fluid temperature of less than 30° C., and 1N of hydrochloric acid was gradually added to achieve a solution pH of 2.0 to dissolve the calcium phosphate hydroxide. After continuous mixing for 30 min, the resin particles were filtered.

Then, the resin particles were suspended with stirring in a 5-fold volume of tap water for 30 min, and then filtered. This sequence was repeated three times. After the sequence were completed, the resin particles were then suspended with stirring in a 5-fold volume of deionized water (electrical conductance: 0.3 μS/cm) for 30 min, and filtered.

Thereafter, the resin particles were dried using a slurry drying device (Disparcoat: Nisshin Engineering K.K.) to obtain toner 14 having a mean particle size of 7 μm.

Embodiment 15

The resin particles were precipitated in the solution by the same sequence as described in embodiment 8.

After cooling, the solution containing the resin particles was maintained at a fluid temperature of less than 30° C., and 2N of hydrochloric acid was gradually added to achieve a solution pH of 1.0 to dissolve the calcium phosphate hydroxide. After continuous mixing for 1 h, the resin particles were filtered.

Then, the resin particles were suspended with stirring in a 5-fold volume of tap water for 30 min, and then filtered. This sequence was repeated three times. After the sequence were completed, the resin particles were then suspended in a 5-fold volume of deionized water (electrical conductance: 0.2 μS/cm) for 30 min, and filtered.

Thereafter, the resin particles were dried using a slurry drying device (Disparcoat: Nisshin Engineering K.K.) to obtain toner 15 having a mean particle size of 7 μm.

Reference Example 1

Resin particles obtained in the same manner as described in embodiment 1 were suspended with stirring in a 5-fold volume of tap water for 30 min, and subsequently filtered. This sequence of suspension and filtration was repeated three times. The resin particles were then dried in the same manner as described in embodiment 1 to obtain toner 16.

Reference Example 2

Resin particles obtained in the same manner as described in embodiment 1 were suspended with stirring in a 5-fold volume of tap water for 30 min, and subsequently filtered. The resin particles were then dried in the same manner as described in embodiment 1 to obtain toner 17.

Reference Example 3

Resin particles obtained in the same manner as described in embodiment 1 were suspended with stirring in a 5-fold volume of deionized water (electrical conductance: 0.1 μS/cm) for 30 min, and subsequently filtered. The resin particles were then dried in the same manner as described in embodiment 1 to obtain toner Reference Example 4

In 400 parts toluene/dichloromethane solution were dissolved 100 parts polyester resin (softening point: 123° C.; Tg=65° C.; Mn=11000; Mw/Mn=15). To this solution were added 8 parts carbon black, 1 part charge controlling agent (TRH; Hodogaya Kagaku), 1 part charge regulating agent (E-S1; Oriental Chemical Co,.) and mixed with a ball mill for 3 hr to obtain a colored resin solution by dispersion.

Fifty parts of the previously described colored resin solution was added to an aqueous dispersion containing 1 part hydroxypropyl cellulose (metrose 65SH-50; Shin-Etsu Chemical Co.) as a dispersion stabilizer, and 1 part potassium lauryl sulfate (Wako Pure Chemical Industry, Ltd.) dissolved in 100 parts water. At this time, the rotational speed of the TK autohomomixer was adjusted so as to form droplets of the aforesaid colored resin solution having a mean particle size of 6 μm. Thereafter, 200 parts distilled water were added, the solution containing the resin particles was maintained at a fluid temperature of 60° C. to remove the toluene/dichloromethane mixture and obtain resin particles.

Then, the resin particles were suspended with stirring in a 5-fold volume of tap water for 30 min, and then filtered. The resin particles were then suspended in a 5-fold volume of deionized water (electrical conductance: 0.2 μS/cm) for 30 min, and filtered. The material was dried in the same manner as described in embodiment 1 to obtain toner 19 having a mean particle size of 6 μm.

Reference Example 5

The resin suspension was regulated in the same sequence as described in embodiment 1, then the toluene was removed from the droplets within the resin suspension, and the resin particles were precipitated. 1N of hydrochloric acid was gradually added to the solution containing the resin particles to achieve a solution pH of 2.5 to dissolve the calcium phosphate hydroxide, and the resin particles were then filtered.

Then, the resin particles were suspended with stirring for 30 min in a 5-fold volume of tap water, then filtered. This sequence of suspension and filtration was repeated three times.

Thereafter, the resin particles were dried using a slurry drier (Disparcoat; Nisshin Engineering) to obtainer toner 20 having a mean particle size of 6 μm.

Reference Example 6

The resin suspension was regulated in the same sequence as described in embodiment 1, then the toluene was removed from the droplets within the resin suspension, and the resin particles were precipitated. Concentrated hydrochloric acid was gradually added to the solution containing the resin particles to achieve a solution pH of 3.0 to dissolve the calcium phosphate hydroxide, and the resin particles were then filtered.

Then, the resin particles were suspended with stirring for 30 min in a 5-fold volume of tap water, then filtered. This sequence of suspension and filtration was repeated twice.

Thereafter, the resin particles were dried using a slurry drier (Disparcoat; Nisshin Engineering) to obtainer toner 21 having a mean particle size of 6 μm.

Reference Example 7

The resin suspension was regulated in the same sequence as described in embodiment 1, then the toluene was removed from the droplets within the resin suspension, and the resin particles were precipitated. Then, 1N of hydrochloric acid was gradually added to the solution containing the resin particles to achieve a solution pH of 1.0 while maintaining a solution temperature of less than 30° C. to dissolve the calcium phosphate hydroxide. After mixing for 30 min, the resin particles were filtered.

Then, the resin particles were suspended with stirring for 30 min in a 10-fold volume of tap water, then filtered. This sequence was repeated ten times. After the sequence were completed, the resin particles were then suspended with stirring in a 10-fold volume of deionized water (electrical conductance: 0.5 μS/cm) for 30 min, and filtered. This sequence was also repeated four times. Flocculation of resin particles occurred during this washing process.

Carrier Manufacture

Eighty parts styrene-acrylic copolymer comprising styrene, methyl methacrylate, 2-hydroxyethyl acrylate, and methacrylate (1.5:7:1.0:0.5) and 20 parts butylated melamine resin were diluted with toluene to produce a styrene-acrylic resin solution having a solid content ratio of 2 percent-by-weight.

Calcined ferrite powder (F-300; mean particle size: 50 μm; high density 2.53 g/cm$^3$; Powder Tech Co.) was used as a core material coated with the aforesaid styrene-acrylic resin solution via a spiller coater (Okada Seiko K.K.), which was then dried. The obtained carrier was calcined for 2 hr at 140° C. within an oven with internal air circulation. After cooling, bulk ferrite powder was classified using a 90 μm screen mesh-mounted screen oscillator with 210 μm orifice to obtain the resin coated ferrite powder. The resin coated ferrite powder was subjected to the aforesaid application, calcination, and classification processes three times to produce a resin-coated carrier.

The mean particle size of the obtained carrier was 52 μm, and the electrical resistance was about $3\times10^{10}\Omega$ cm.

Evaluation of Characteristics

The characteristics of the toners of the previously described embodiments and reference examples were evaluated as described below.

(1) Measurement of electrical conductance

Ten parts of the toners obtained in embodiments 1~9 and reference examples 1~4 were added to 100 parts deionized water (conductance: 0.1 μS/cm) so as to become wetted, and then mixed with a stirrer for 30 min. The material was filtered to remove the toner, then the solution was placed in a beaker and the solution temperature was set at 23°±2° C. Electrical conductance was measured by conduction meter (pocket conduction meter model SC-51; Yokogawa Hokushin Denki K.K.).

(2) Measurement of calcium amount

About 2 mg of the toner particles obtained from embodiments 10~15 and reference examples 5 and 6 were cleaned, dissolved in 5 ml concentrated nitric acid, allowed to dry and harden, then the residue was dissolved in 5 ml concentrated nitric acid and heated to derive about 2 ml concentrate. The solution was diluted to 100 ml with pure water, and the sample material for measurement was obtained by filtering the solution.

The calcium density of the obtained sample was measured by an ICP spectral analyzer (SPS-7000; Seiko Electric). The measured density value was used to calculate the amount of total calcium within all the toner particles measured, the ratio of the weight of the calcium to the weight of the toner was determined to derive the residual calcium in the toner. When measurement was performed in this same manner to the toner of reference example 7, the amount of residual calcium was 0.1 ppm.

(3) Measurement of Charge

To 100 parts toner obtained in embodiments 1~15 and reference examples 1~6 were added 0.3 parts hydrophobic silica (H-2000; Wakker K.K.) and 0.5 parts hydrophobic titanium oxide (T-805; Nippon Aerosil K.K.), and mixed for 1 min at 1,000 rpm in a Henschel mixer (Mitsui Miike Kakoki K.K.). Thus obtained particles and the aforesaid carrier were mixed at a ratio of 5:95 by weight to produce the developers used in the evaluations.

Thirty grams of the developer were added to 50 ml of polyethylene, and stirred at 1200 rpm for 90 min. The developer was brought into contact with a film previously charged with a predetermined charge, and the amount of the toner adhering to the film was measured to determine the amount of toner charge. After storing for 24 hr at 85% humidity and temperature of 30° C., the developer was similarly stirred, and the charge measured in the same manner. The amount of charge was measured at normal temperature and humidity (25° C., 60% humidity).

(4) Inadequately charged toner

Developers were prepared and stirred in the same sequence as in the measurement of charge amount using the toners of embodiments 1~15 and reference examples 1~6. Three grams of the developer was disposed on the surface of a magnet roller having a diameter of 310 mm. Then, a electrode weighed using a precision balance was set, and a bias voltage of 1 kV having a polarity opposite to the polarity of the toner was applied, and the magnet roller was rotated for 1 min at 1,000 rpm. The electrode was again weighted, and the amount of toner separated and adhering to the facing electrode, i.e., the amount of inadequately charged toner, was calculated via the difference relative to the initial value. The percentage of inadequately charged toner to the amount of total toner measured was used as the amount of inadequately charged toner. After storage for 24 hr at 30° C. and 85% humidity, the amount of inadequately chargee toner was again measured by the same sequence. Measurements were performed at normal temperature and humidity (25° C., 60% humidity).

(5) Post-printing Charge Amount

Developers were prepared and stirred in the same sequence as in the measurement of charge amount using the toners of embodiments 1~15 and reference examples 1~6, and placed in the developing device of a commercial color copier (Minolta; model CF-80), and 1,000 copies were continuously printed. Thereafter, the developer was removed from the developing device and the amount of charge was measured by the same sequence as in the measurement of charge amount.

The results of these evaluations are shown in Tables 1 and 2.

TABLE 1

| | Conductance (μS/cm) | Initial charge (μC/g) | Charge after storage at H/H (μC/g) | Initial inadequately charged toner (wt %) | Inadequately charged toner after storage at H/H (μC/g) |
|---|---|---|---|---|---|
| Emb. 1 | 23 | 33 | 30 | 0.1 | 0.3 |
| Emb. 2 | 35 | 32 | 36 | 0.2 | 0.3 |
| Emb. 3 | 42 | 31 | 27 | 0.3 | 0.5 |
| Emb. 4 | 80 | 30 | 24 | 0.4 | 1.5 |
| Emb. 5 | 14 | 34 | 31 | 0.1 | 0.2 |
| Emb. 6 | 3 | 35 | 32 | 0.0 | 0.2 |
| Emb. 7 | 29 | 33 | 29 | 0.2 | 0.4 |
| Emb. 8 | 48 | 34 | 32 | 0.1 | 1.7 |
| Emb. 9 | 27 | 29 | 26 | 0.8 | 1.9 |
| Ref. Ex. 1 | 248 | 26 | 20 | 1.0 | 6.5 |
| Ref. Ex. 2 | 825 | 14 | 5 | 4.8 | 30.7 |
| Ref. Ex. 3 | 431 | 20 | 12 | 1.5 | 12.4 |
| Ref. Ex. 4 | 123 | 32 | 26 | 0.2 | 3.6 |

TABLE 2

| | Residual calcium (ppm) | Initial charge (μC/g) | toner after storage at H/H (μC/g) | Initial amount inadequately charged toner (wt %) | Inadequately charged toner after storage at H/H (wt %) | Charge after 1000 printings |
|---|---|---|---|---|---|---|
| Emb. 10 | 0.5 | 33 | 31 | 0.2 | 0.5 | 31 |
| Emb. 11 | 0.2 | 34 | 30 | 0.3 | 0.6 | 29 |
| Emb. 12 | 1.0 | 32 | 29 | 0.1 | 0.2 | 30 |
| Emb. 13 | 5.0 | 32 | 28 | 0.2 | 0.4 | 30 |
| Emb. 14 | 9.0 | 30 | 26 | 0.4 | 1.5 | 26 |
| Emb. 15 | 6.5 | 30 | 25 | 0.3 | 1.8 | 27 |
| Ref. Ex. 5 | 18.0 | 26 | 20 | 1.2 | 4.5 | 17 |
| Ref. Ex. 6 | 26.0 | 24 | 15 | 4.8 | 15.6 | 10 |

As can be understood from the data of Table 1, The toners of embodiments 1~9 have an adequate charge, the amount of inadequately charged toner is extremely slight, and there is scant change in charging characteristics after storage at high temperature and high humidity. In contrast, the toners of reference examples 1~4, when stored at high temperature and high humidity, exhibited charge reduction, and an increase in the amount of inadequately charged toner which adversely affected charging characteristics. The toners of reference examples 2 and 3 in particular did not have adequate charges prior to storage, had the largest amounts of inadequately charged toner, exhibited extreme deterioration of charging characteristics after storage at high temperature and high humidity.

As can be understood from the data of Table 2, the toners of embodiments 10~15 had adequate charges, and only slight amounts of inadequately charged toner. Furthermore, charge reduction did not occur and the amount of inadequately charged toner did not increase even after storage at high temperature and high humidity, and there was only slight charge loss after printing continuous copies. In contrast, in reference examples 5 and 6 which had large amounts of residual calcium, adequate charging was not obtained, much of the toner was inadequately charged, and there was marked deterioration after storage at high temperature and high humidity. The loss of charge was great after printing continuous copies, rendering these toner unusable.

The toner of reference example 7 produced flocculation of particles during cleaning, such that the desired particle size toner was unobtainable.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A resin-formed toner for electrostatic latent image developing, which is prepared by a wet process and has an electroconductivity of 1 to 100 μS/cm, said electroconductivity being measured for a solution prepared by dispersing the toner of 10 parts by weight into a deionized water of 100 parts by weight.

2. The toner as claimed in claim 1 wherein said wet process comprises steps of:

dispersing a raw material fluid of resin into a dispersion fluid to form liquid droplets, wherein said dispersion fluid contains a dispersion stabilizer;

precipitating a solid resin from the droplets in order to form resin particles; and separating the resin particles from the dispersion fluid.

3. The toner as claimed in claim 2 wherein said dispersion stabilizer comprises a member selected from the group consisting of calcium phosphate hydroxide and polyvinyl alcohol.

4. The toner as claimed in claim 2 wherein said dispersion fluid further comprises a surfactant as a dispersion co-stabilizer.

5. The toner as claimed in claim 4 wherein said dispersion co-stabilizer comprises a member selected from the group consisting of sodium lauryl sulfonate and dodecyl benzene sodium sulfonate.

6. The toner as claimed in claim 2 wherein said raw material fluid comprises a nonaqueous solvent dissolved a resin thereinto, and wherein said dispersion fluid comprises an aqueous solvent, and wherein said precipitating step is performed by removing the nonaqueous solvent from the droplets.

7. The toner as claimed in claim 2 wherein said raw material fluid comprises a mixture of a polymerization monomer and a polymerization initiator, and wherein said precipitating step is performed by heating the dispersion fluid to polymerize the monomer dispersed thereinto.

8. The toner as claimed in claim 1 wherein the glass transition point of the resin is in the range between 50° and 70° C.

9. The toner as claimed in claim 1 wherein the number average molecular weight of the resin is in the range between 1,000 and 50,000.

10. The toner as claimed in claim 1 wherein said resin satisfies the following relationship:

$$20 \leq Mw/Mn \leq 60$$

wherein Mw represents weight average molecular weight and Mn represents number average molecular weight.

11. The toner as claimed in claim 1 which further comprises a colored pigment.

12. The toner as claimed in claim 11 wherein said pigment is in the range between 1 and 20 parts by weight on the basis of the toner of 100 parts by weight.

13. The toner as claimed in claim 1 which further comprises a charge controlling agent.

14. The toner as claimed in claim 1 which further comprises a magnetic powder.

15. The toner as claimed in claim 1 which further comprises an off set preventing agent.

16. The toner as claimed in claim 1 which has a mean particle size of 2 to 15 μm.

17. A resin-formed toner for electrostatic latent image developing, which is prepared by a wet process and contains calcium of 0.2 to 10 ppm on the basis of the toner.

18. The toner as claimed in claim 17 wherein said wet process comprises steps of:

dispersing a raw material fluid of resin into a dispersion fluid to form liquid droplets, wherein said dispersion fluid contains a dispersion stabilizer containing calcium;

precipitating a solid resin from the droplets in order to form resin particles; and separating the resin particles from the dispersion fluid.

19. The toner as claimed in claim 18 wherein said dispersion stabilizer comprises calcium phosphate hydroxide.

20. The toner as claimed in claim 18 wherein said dispersion fluid further comprises a surfactant as a dispersion co-stabilizer.

21. The toner as claimed in claim 20 wherein said dispersion co-stabilizer comprises a member selected from the group consisting of sodium lauryl sulfonate and dodecyl benzene sodium sulfonate.

22. The toner as claimed in claim 18 wherein said raw material fluid comprises a nonaqueous solvent dissolved a resin thereinto, wherein said dispersion fluid comprises an aqueous solvent, and wherein said precipitating step is performed by removing the nonaqueous solvent from the droplets.

23. The toner as claimed in claim 18 wherein said raw material fluid comprises a mixture of a polymerization monomer and a polymerization initiator, and wherein said precipitating step is performed by heating the dispersion fluid to polymerize the monomer dispersed thereinto.

24. The toner as claimed in claim 20 wherein the proportion of said dispersion co-stabilizer relative to the dispersion stabilizer is in the range between 1/1000 and 10/100 parts by weight.

25. The toner as claimed in claim 17 which further comprises a pigment as a colorant.

26. The toner as claimed in claim 17 which further comprising a charge controlling agent.

27. The toner as claimed in claim 17 which has a mean particle size of 2 to 15 μm.

28. A method for preparing a resin-formed toner for electrostatic latent image developing, comprising steps of:

dispersing a raw material fluid of resin into a dispersion fluid to form liquid droplets, wherein said dispersion fluid contains a dispersion stabilizer;

precipitating a solid resin from the droplets in order to form resin particles;

washing the resin particles by water repeatedly, wherein final washing is performed by deionized water; and drying the particles which are washed by the deionized water.

29. The method as claimed in claim 28 wherein the electroconductivity of the deionized water is not more than 0.5 μS/cm.

30. The method as claimed in claim 28 wherein the washing comprises:

dispersing the resin particles into water;

stirring the water to disperse the particles; and filtering out the particles from the water.

31. The method as claimed in claim 28 wherein the water used in the washing is warmed.

32. A method for preparing a resin-formed toner for electrostatic latent image developing, comprising:

dispersing a raw material fluid of resin into a dispersion fluid to form liquid droplets, wherein said dispersion fluid contains a dispersion stabilizer containing calcium;

precipitating a solid resin from the droplets in order to form resin particles;

applying an acid solution to the resin particles; and washing the resin particles with water repeatedly, wherein the final washing is performed by deionized water; and drying the washed particles.

33. The method as claimed in claim 32, wherein the electroconductivity of the deionized water is not more than 0.5 μS/cm.

34. The method as claimed in claim 32 wherein the pH of the acid solution is in the range between 1 and 2.

35. The method as claimed in claim 32 wherein the applying is performed by immersing the resin particle into the acid solution.

36. The method as claimed in claim 35 wherein the temperature of the acid solution dispersed the resin particle thereinto is kept at 30° C. or below.

37. The method as claimed in claim 35 which further comprises stirring the acid solution dispersed the resin particle thereinto.

38. The method as claimed in claim 35 which further comprises filtering out the resin particle in the acid solution.

39. A resin-formed toner for electrostatic latent image developing, which is prepared by an emulsion dispersion method and has an electroconductivity of 1 to 100 μS/cm, said electroconductivity being measured by dispersing 10 parts by weight of the toner into 100 parts by weight of deionized water.

40. The toner according to claim 39, wherein said emulsion dispersion method comprises:

dispersing a raw material fluid of resin into a dispersion fluid to form liquid droplets, wherein said dispersion fluid contains a dispersion stabilizer;

forming a solid resin from the droplets in order to form resin particles; and separating the resin particles from the dispersion fluid, wherein said raw material fluid comprises a nonaqueous solvent having a resin dissolved therein, said dispersion fluid comprises an aqueous solvent, and wherein said precipitating step is performed by removing the nonaqueous solvent from the droplets.

41. A resin-formed toner for electrostatic latent image developing, which is prepared by an emulsion dispersion method and contains calcium of 0.2 to 10 ppm on the basis of the toner.

42. The toner according to claim 41, wherein said wet process comprises:

dispersing a raw material fluid of resin into a dispersion fluid to form liquid droplets, wherein said dispersion fluid contains a dispersion stabilizer containing calcium;

forming a solid resin from the droplets in order to form resin particles; and separating the resin particles from the dispersion fluid, wherein said raw material fluid comprises a nonaqueous solvent having a resin dissolved therein, said dispersion fluid comprises an aqueous solvent, and said precipitating step is performed by removing the nonaqueous solvent from the droplets.

43. The method according to claim 28, wherein said particles produced thereby has an electroconductivity of 1 to 100 μS/cm, said electroconductivity being measured by dispersing 10 parts by weight of the toner into 100 parts by weight of deionized water.

44. The method according to claim 32, wherein said particles produced thereby contains calcium of 0.2 to 10 ppm on the basis of the particles.

45. The method according to claim 28, wherein said dispersion fluid is an aqueous solution.

46. The method according to claim 32, wherein said dispersion fluid is aqueous solution.

* * * * *